United States Patent [19]

Hess et al.

[11] Patent Number: 4,580,200

[45] Date of Patent: Apr. 1, 1986

[54] LIGHTING FIXTURE

[75] Inventors: Jean M. Hess, Clermont Ferrand; Gabriel D. M. Prevostat, Chateaugay, both of France

[73] Assignee: ITT Industries, Inc., New York, N.Y.

[21] Appl. No.: 667,117

[22] Filed: Nov. 1, 1984

[30] Foreign Application Priority Data

Nov. 7, 1983 [FR] France ..... 83 17642

[51] Int. Cl.[4] ..... F21V 29/00

[52] U.S. Cl. ..... 362/223; 362/260; 362/267; 362/374

[58] Field of Search ..... 362/147, 148, 150, 217, 362/223, 225, 267, 364, 374, 375, 260, 310, 375

[56] References Cited

U.S. PATENT DOCUMENTS

| | | | |
|---|---|---|---|
| 2,983,813 | 5/1961 | Pfaff | 362/223 |
| 3,676,665 | 7/1972 | Louis | 362/374 |
| 4,138,716 | 2/1979 | Muhlethaler et al. | 362/267 |

FOREIGN PATENT DOCUMENTS

| | | | |
|---|---|---|---|
| 688152 | 6/1964 | Canada | 362/374 |
| 788854 | 7/1968 | Canada | 362/374 |
| 1395144 | 5/1975 | United Kingdom | 362/374 |

*Primary Examiner*—Craig R. Feinberg
*Assistant Examiner*—David A. Okonsky
*Attorney, Agent, or Firm*—James B. Raden; Donald J. Breh

[57] ABSTRACT

A light fixture is provided comprising a top elongated curved section and a matching bottom elongated curved section. The top section is fitted to the bottom section along their longitudinal edges and an elongated clip along the length of each edges holds the diffuser bottom section to the top reflector section. A seal is provided along the length of the clips to insure that the light fixture is impervious to dust or other undesirable contaminants. End sections join the top and bottom sections to form a closed light fixture.

5 Claims, 6 Drawing Figures

LIGHTING FIXTURE

BACKGROUND OF THE INVENTION

This invention relates to a closed fluorescent lamp light fixture and more particularly, to a lighting fixture consisting essentially of a body attached to a support and enclosing the lamp holders, the lamp accessories, a reflector, and a diffuser which completes the body and diffuses the light produced by the lamp or lamps.

Fluorescent light fixtures are well known and are often referred to as weatherproof light fixtures because of the precautions which are taken at the joint between the body and the diffuser and at other openings in the body to protect the interior of the fitting from dust and streams of water, which enables them to be used in quite harsh environments such as basements, cellars, covered parking, etc.

These light fixtures having the required sealing consist generally of a hollow body, the continuous rim of which is provided with a waterproof gasket, and a hollow diffuser, the continuous rim of which is pressed against the gasket, together with latches attaching the diffuser to the body. The reflector carrying the lamp holders and accessories is incorporated into the body.

Such a design, although technically satisfactory, is nevertheless relatively expensive. In particular, the various elements have to be shaped or molded individually. In addition, some of the parts are cumbersome which involves high storage and transport costs.

The objective of the invention is therefore to achieve a light fixture more suited to available manufacturing techniques and consequently of lower cost and offering advantages in storage and transport.

SUMMARY OF THE INVENTION

According to essential features of the invention, the light fixture consists essentially of a half-shell body open at its ends, a diffuser having a half-shell shape with open ends and designed to complete said body, two end pieces arranged to close the ends of an assembled body and diffuser, together with sealing arrangements provided between said diffuser and said body and between said diffuser and said end pieces. The end pieces may be extensions of the body or may be welded, bonded or assembled to its with weatherproof seals.

In such a type of light fixture, the body and/or the diffuser may be pieces cut from very long sections, thereby leading to low cost production. The end pieces are usually relatively small molded parts.

Another feature of the invention is that the body and/or said diffuser have an open profile. This allows the light fixtures to be stored and transported disassembled with the most cumbersome parts packed one inside the other. The end pieces contain a portion which fits between the body and the diffuser whose profile is matched to that of the two parts and which carries a weather-proof seal against which the body and the diffuser rest. Such an arrangement allows the diffuser to be separated from the body of the fixture and so to open and close in after assembly. The end pieces carry the lamp sockets and optionally, a starter device. The fluorescent lamp ballast inductance will be attached in the top of the body.

Another feature of the invention is that the edges of the body and the diffuser are shaped in such a way as to allow a flexible shaped strip to be clipped on, thereby enclosing the two edges and pressing them together over their entire length with a sealing gasket between them. The configuration of this section and the edges is such that it allows the rotation of the diffuser, while held by one clip left in place on one side of the light fitting when the clip on the other side has been detached, and consequently the opening of the fixture without the diffuser being separated from the body.

BRIEF DESCRIPTION OF THE DRAWINGS

In the drawings,

Referring now to FIG. 1, there is shown a partial view of the end of a light fixture produced in accordance with the present invention. The essential parts of this light fixture are seen as a body 1, a diffuser 2, an end piece 3 and a clip 4 joining body 1 to diffuser 2.

Body 1 is a sort of elongated half-shell, open at both ends. In one method of manufacture, it would be obtained by cutting up a steel section provided with an anti-corrosive coating and continuously formed from a steel sheet. This coating could be in "Aluzinc", a trademark of and produced by the manufacturer Bethlehem Steel among others, which has the advantage of being reflecting. The light fixture thus does not need a reflector which reduces its production cost.

Diffuser 2, is likewise a sort of half-shell, open at both ends, which could be obtained by cutting an extruded section of transparent or translucent plastic material such as a polycarbonate.

These two parts when assembled face to face form a sort of open tube which is completed at each extremity by an end piece such as 3, the shape of which is matched to the profile of this assembly and which it caps and closes off.

The assembly of the two longitudinal elements of the light fixture body 1 and diffuser 2, is secured by means of clips 4, one on each side.

Figure 2:
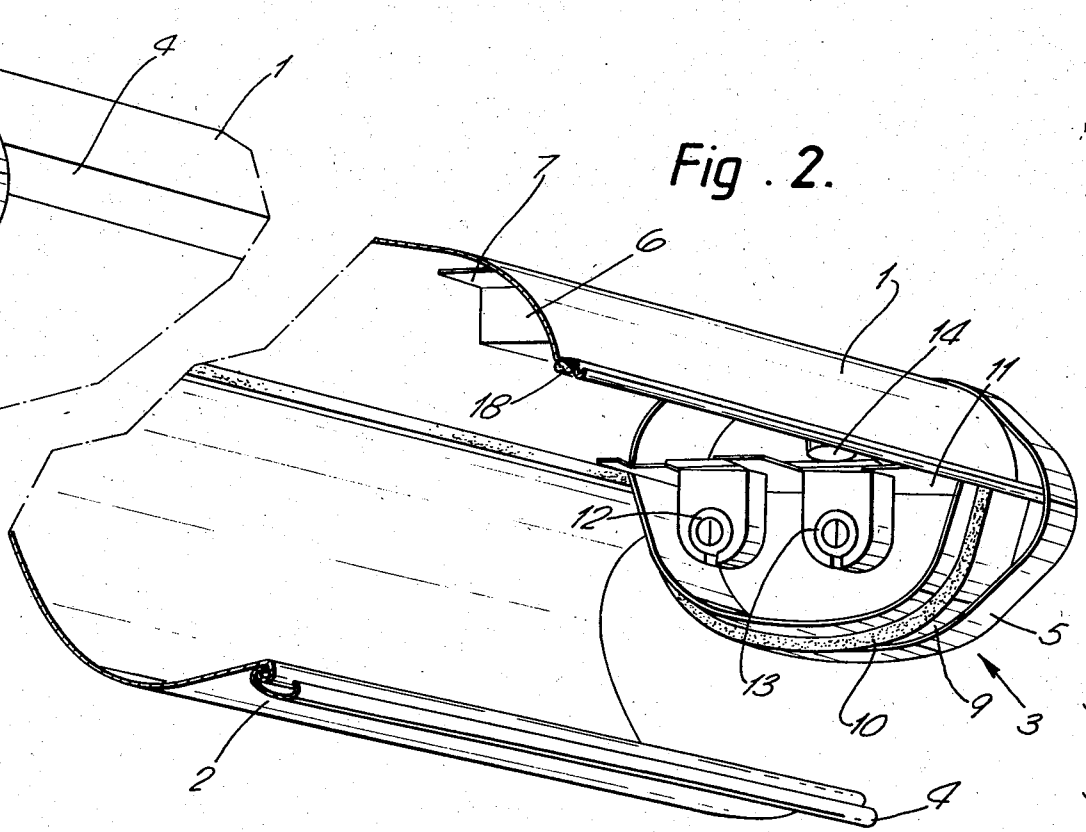
FIG. 2 is a partial perspective view of the other end of the light fixture of FIG. 1 with the diffuser open.
Figure 1:
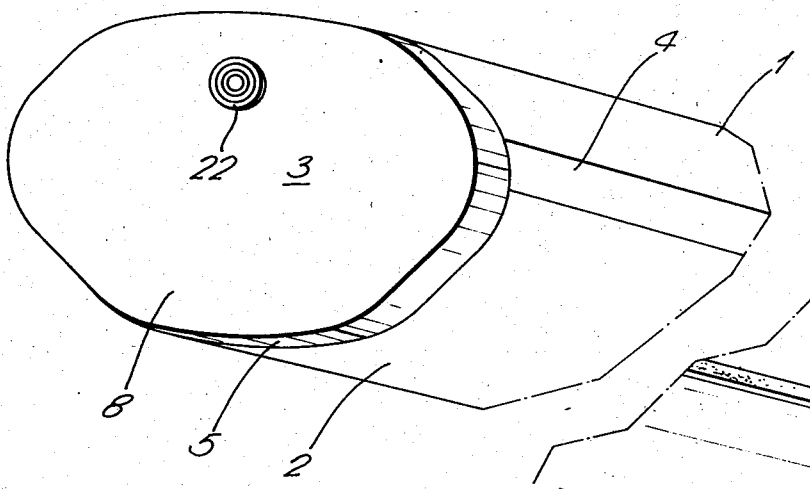
FIG. 1 is a partial perspective view of one end of an embodiment of the light fixture of the invention with the diffuser closed.

FIG. 2 illustrates the other end of the light fixture of FIG. 1 but with the diffuser in the open position which enables the interior to be seen. In particular, a ballast inductance 6 is partially visible. Ballast 6 is fixed into the top of the body by sealed rivets 7, for example, in good thermal contact with the body, for better cooling.

The clip 4, which will be described later, is such that when it is in place, it allows the diffuser to pivot and the light fixture to open. Unclipped, it remains attached to the diffuser, as can be seen in the lower part of FIG. 2.

The end piece 3 has a lip 5 and a side wall 8 also visible in FIG. 1; it also has an internal flange 9 on which a sealing gasket is fixed, by sticking with an adhesive, for example. A transverse wall 11 carries two sockets 12 and 13, for example, which comprise the normal fluorescent lamp end fittings. One of these may be a combination socket containing an ignition device 14.

When the diffuser 2 is raised to take up the position shown in FIG. 1, its inner surface near to its extremity is pressed against the seal 10 of the end piece 3, the profile of the diffuser and that of the interior flange 9 being matched to produce a sealed closure. This aspect is more fully illustrated in FIG. 3 which shows a cross sectional view of the light fixture in which for clarity, the contents of the light fixture such as lamps, etc., are not shown.

Figure 3:
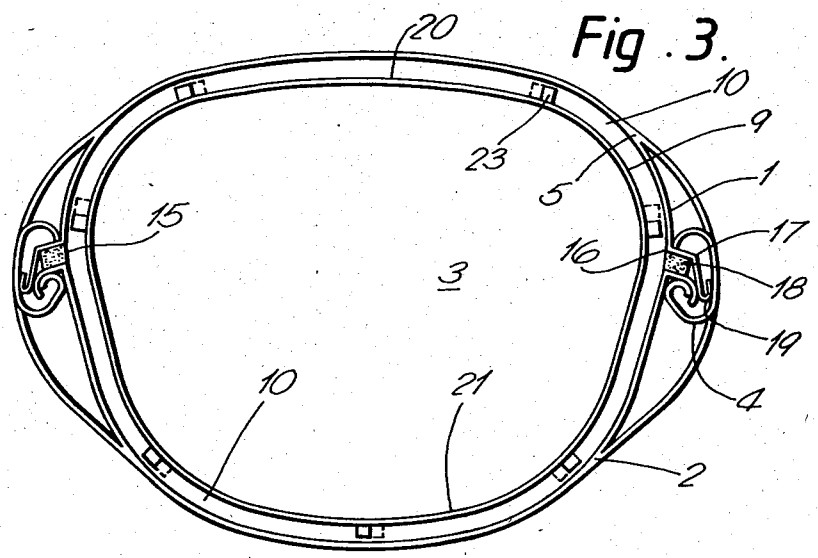
FIG. 3 is a cross sectional view of the light fixture of FIG. 1.

Referring to FIG. 3, body 1 can be seen, whose flared profile from bend 15 to bend 16 is extended by two identical flanges comprising an initial section 17 carrying a longitudinal seal 18 and a further section turned back into a hook shape. The profile of body 1 is relatively open such that storage and transport of the light fixtures will be made easier by the fact that a large number of such bodies may be fitted into each other to pack them into a small volume. The internal flange 9 of end piece 3 comprises a section 20 closely matching the shape of body 1 and carrying the seal 10, just like the section visible in FIG. 2. Body 1 thus against this seal which provides sealing between itself and the end piece 1 up to the point of longitudinal seal 18.

From longitudinal seal 18, the section of flange 9 follows the profile of diffuser 2, which also fits against seal 10 when it is fastened to body 1. The fit is such that the internal flange 9 of end piece 3 provides a complete seal with the inside of the tubular structure formed by body 1 and diffuser 2. The longitudinal junction between the edges of body 1 and diffuser 2 contains a seal 18 at each side of the light fixture such that the interior of the light fixture is effectively protected from the external environment. For completeness, it should also be noted that the end pieces also contain a cable entry 22 which will also be provided with a sealing device.

Figure 4:
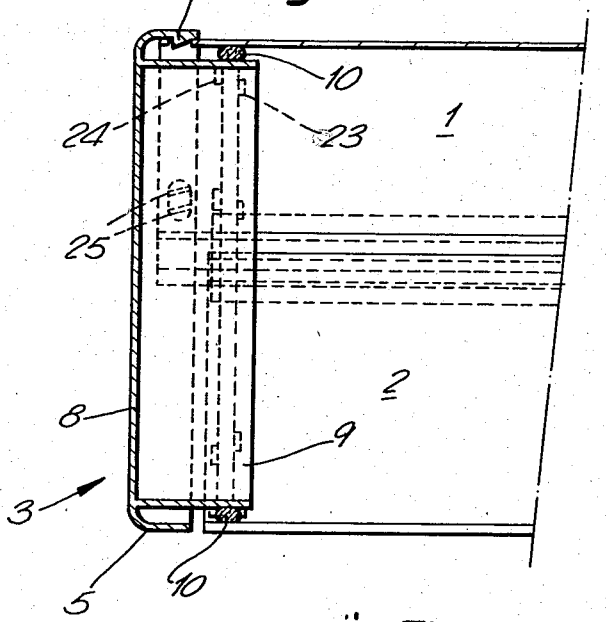
FIG. 4 is a partial longitudinal sectional view of the light fixture of FIG. 1.

FIG. 4 illustrates the method of assembly of an end piece 3 to the body 1 and the diffuser 2. The end piece 3 can be seen in sectioned view as a flat bottomed cup, side wall 8 of which extends at right angles to internal flange 9, with lip 5 extending outside thereof with a rounded junction to side wall 8. Flange 9, which carries seal 10 has already been discussed. It can be added that flange 9 also includes molded lugs 23, 24 with dual role: to retain seal 10 in position and to prevent it being crushed. These lugs, arranged in pairs around the flange (see FIG. 3) are slightly narrower than the thickness of the seal for this reason. Lip 5 carries flexible fixing lugs 25 designed to engage in openings provided near the extremity of body 1. These openings will preferably be made during the cutting operation on the section from which body 1 is produced.

The end piece 3 is thus attached to body 1 which fits between the inner flange 9, on top of seal 10, with lip 5 extending over it. Diffuser 2 on the contrary, is shorter and stops short of the lip 5, as shown in FIG. 4. Nevertheless, it is long enough to rest firmly on the seal 10 of both end pieces.

Figure 6:
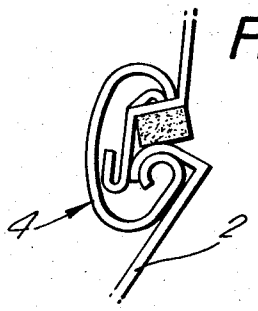
FIG. 6 is a cross sectional view of the same joint as FIG. 5 with the diffuser open.
Figure 5:
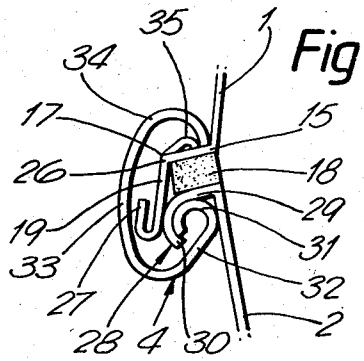
FIG. 5 is a cross sectional view of the joint between the edges of the body and the diffuser of the light fixture of FIG. 1.

FIGS. 5 and 6 are two larger scale, cross sectional views of a joint between the edges of body 1 and diffuser 2, using a clip 4. In greater detail, a section of body 1 extends into a flange which consists successively of an outward bend 15, a flat part 17 which carries the seal, inward bend 19, from which the flange extends into a hook, the end part 27 of which is bent outwards. From place to place, the flat part 17 has a protrusion 35 with a slight slope from bend 17 and returning sharply towards part 17 just before bend 15.

This flat part, as can be seen, carries the longitudinal seal 18. The protrusions 35 serve to engage with the clip 4.

On the other side of seal 18, diffuser 2 terminates in a flange 28 composed of a wing 29, at right angles outwards and extended by a rounded part 30. The wing 29 presses firmly against the seal 18. The rounded part accepts the end of clip 4.

This clip 4, with a general 'C' shape, is an extruded section, usually comprised of flexible but strong PVC for example. It comprises a loop 31, which engages inside the rounded section 30, a connecting limb 32, an upright 33 and a hook 34.

As can be seen in FIG. 5, this clip bears on the inside of the rounded section 30 and is fastened by its extremity 34 behind the protrusions 35 in the corner 15. The elasticity of the material from which it is made and the dimensioning of the section 4 are that this section exercises a force pressing the edges of body 1 and diffuser 2 together, and uniformly pinching seal 18. This keeps the light fixture closed and ensures sealing. On the inside of the clip 4, the hook section 19 presses against it with its end part 27 while its main member bears against the rounded part 30.

These arrangements isolate the seal 18 from the external environment to prevent any accumulation of dust on its exposed parts which might eventually impair the sealing after the diffuser has been removed and replaced several times. Additionally they prevent unintentional unfastening of the clip in the event of accidental side pressure against it.

Finally, FIG. 6 illustrates the same joint as in FIG. 5, except that diffuser 2 has been detached by unfastening the clip 4 on the opposite side (see FIG. 2) and has been rotated in clockwise direction. It can be seen that diffuser 2 remains attached on one side by the clip 4 still in place.

It is quite evident that the preceding descriptions have been given as non-limiting examples and that numerous variants may be envisaged without departing from the scope of the invention. In particular, the end pieces could be attached to the body 1 by welding, bonding or be extensions of the body 1, which would then dispense with the need for a seal between these parts and the body.

What is claimed is:

1. A light fixture comprising:

an elongated, generally half-shell shaped body open on opposing ends and including two body flanges, one body flange along each one of a pair of opposing longitudinal edges of said body extending between said open ends, each said body flange including an outwardly extending planar portion;

an elongated, generally half-shell shaped light diffuser open on opposing ends including a pair of diffuser flanges, one of said pair of diffuser flanges along each one of a pair of longitudinal edges of said diffuser extending between said open ends of said diffuser, each of said diffuser flanges including an outwardly extending, substantially planar wing portion, and an inwardly orientated rounded the portion depending from said wing portion;

two end pieces, each mounted to said body over a respective one of said open ends;

first seal means mounted to said two end pieces of sealingly engaging said body and said diffuser to said end pieces;

second seal means each said planar portion of each said body flange and each said wing portion of each said diffuser flange; and a pair of one piece combination hinge and resilient clamp members, each hinge and clamp member engaged to a respective one of said body flanges and said diffuser flanges along substantially the entire length thereof, each said combination hinge and resilient clamp member including a one piece elongated, generally c-shaped resilient member having a first end resiliently and removably engaged against said planar portion of said body flange defining a clamp and having a rounded second end complimentary with and pivotably retained within said rounded portion of said diffuser flange defining a hinge; whereby, said diffuser and said body are clamped together with said second seal means between said body flange and said diffuser flange when said clamp of each said clamp and hinge member is engaged to said body flange and said diffuser is pivotable along either longitudinal edge thereof about said hinge of one of said clamp and hinge members when said clamp portion of the other of said clamp hinge members is disengaged from the flange of said body.

2. The light fixture of claim 1, wherein said end pieces include an element arranged to be introduced between the body and the diffuser and whose profile is matched to that presented by these two parts together, said element carrying said first seal means against which the body and the diffuser are pressed.

3. The light fixture of claim 1, wherein said end pieces are attached to said body by flexible fixing lugs engaged in suitable openings in said body.

4. The light fixture of claim 1, wherein said planar portion of said body flange includes a projection, said one end of said clamp and hinge member received against said planar portion between said body and said projection.

5. The light fixture of claim 1, wherein said body flange further includes a depending portion having a free end folded over itself defining a hook at said free end, said hook fits between an outer surface of the rounded portion of said diffuser flange and an inner surface of said resilient clamp and hinge member at a location between said first end thereof said rounded second end thereof.

* * * * *